United States Patent [19]

Brooks et al.

[11] Patent Number: 4,818,126

[45] Date of Patent: Apr. 4, 1989

[54] METHOD AND APPARATUS FOR THERMALLY PRINTING DATA IN SPECIAL FONTS ON DOCUMENTS LIKE CHECKS

[75] Inventors: Ralf M. Brooks, Waterloo; Alan R. Quelch, Cambridge; Philip J. Wilkinson, Nepean, all of Canada

[73] Assignee: NCR Canada Ltd - NCR Canada Ltee, Mississauga, Canada

[21] Appl. No.: 561,449

[22] Filed: Dec. 14, 1983

[51] Int. Cl.[4] ..... B41J 3/20

[52] U.S. Cl. ..... 400/120; 400/601; 400/636; 400/642; 400/65.2; 400/656; 346/76 PH

[58] Field of Search ..... 400/120, 159, 160, 161, 400/656, 657, 601, 619, 636, 642, 649, 652, 653, 55, 56, 105, 121, 124, 247, 248, 618, 696; 346/76 R, 76 L, 76 PH, 1.1

[56] References Cited

U.S. PATENT DOCUMENTS

| | | | |
|---|---|---|---|
| 3,586,149 | 6/1971 | Miller | 400/618 |
| 3,789,423 | 1/1974 | Fawcett | 346/76 R |
| 3,951,247 | 4/1976 | Montanari | 400/120 |
| 4,000,393 | 12/1976 | Cochran et al. | 219/216 |
| 4,013,159 | 3/1977 | Okabe | 400/120 |
| 4,039,065 | 8/1977 | Seki et al. | 400/120 |
| 4,070,680 | 1/1978 | Shelley | 346/76 R |
| 4,145,756 | 3/1979 | Cochran et al. | 364/900 |
| 4,151,397 | 4/1979 | Boor, Jr. et al. | 346/76 PH |
| 4,170,422 | 10/1979 | Bilek | 400/120 |
| 4,195,937 | 4/1980 | Baran | 400/120 |
| 4,197,023 | 4/1980 | DeBoo et al. | 400/56 X |
| 4,243,330 | 1/1981 | Wallace et al. | 400/642 X |
| 4,253,774 | 3/1981 | Hanakata et al. | 400/120 X |
| 4,358,776 | 11/1982 | Mitsui | 346/76 PH |
| 4,387,380 | 6/1983 | Asakura et al. | 346/76 PH |
| 4,394,092 | 7/1983 | Osmera et al. | 400/120 |
| 4,408,908 | 10/1983 | Applegate et al. | 400/120 |
| 4,439,777 | 3/1984 | Aprato | 400/120 X |
| 4,491,853 | 1/1985 | Hayashi et al. | 400/120 X |
| 4,531,132 | 7/1985 | Wilkinson | 346/1.1 X |

FOREIGN PATENT DOCUMENTS

| | | | |
|---|---|---|---|
| 370303 | 3/1923 | Fed. Rep. of Germany | 400/656 |
| 0055543 | 5/1977 | Japan | 400/120 |
| 0061484 | 5/1980 | Japan | 400/124 |
| 0049289 | 5/1981 | Japan | 400/656 |
| 0008664 | 1/1983 | Japan | 400/121 |
| 0020482 | 2/1983 | Japan | 400/120 |
| 0107381 | 6/1983 | Japan | 400/656 |
| 2026392 | 2/1980 | United Kingdom | 400/642 |
| 2033843 | 5/1980 | United Kingdom | 400/120 |

OTHER PUBLICATIONS

IBM Technical Disclosure Bulletin, "Springloaded Floating Platen Assembly", Cole et al., vol. 20, No. 6, Nov. 1977, pp. 2366–2367.

IBM Technical Disclosure Bulletin, "Single Circuit/-Head Assembly For Nonimpact Printer", Regehr et al., vol. 22, No. 4, Sep. 1979, p. 1593.

IBM Technical Disclosure Bulletin, "Electrothermal Ribbon Path", Applegate et al., vol. 23, No. 5, Oct. 1980, p. 2012.

*Primary Examiner*—Ernest T. Wright, Jr.

*Attorney, Agent, or Firm*—Albert L. Sessler, Jr.; Elmer Wargo

[57] ABSTRACT

A thermal printing apparatus including a print station, a transport mechanism for positioning a record medium at the print station, an arcuately-shaped platen, a line of printing elements and a thermally responsive ribbon. Relative movement between the platen and the printing elements is effected from a pivot point. Printing in a variety of styles of fonts like E13B is possible on documents like checks or deposit slips, for example. Special spring and wire members facilitate the separation of the ribbon from the document after printing.

8 Claims, 5 Drawing Sheets

FIG. 11A
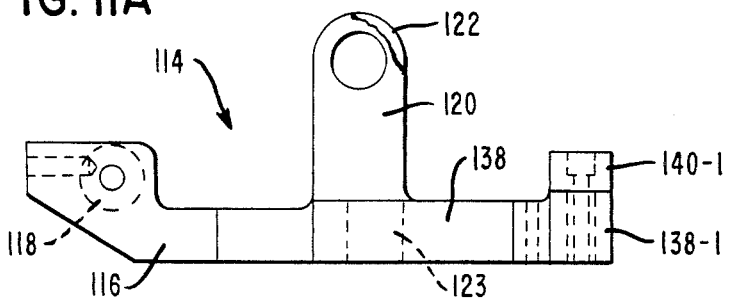
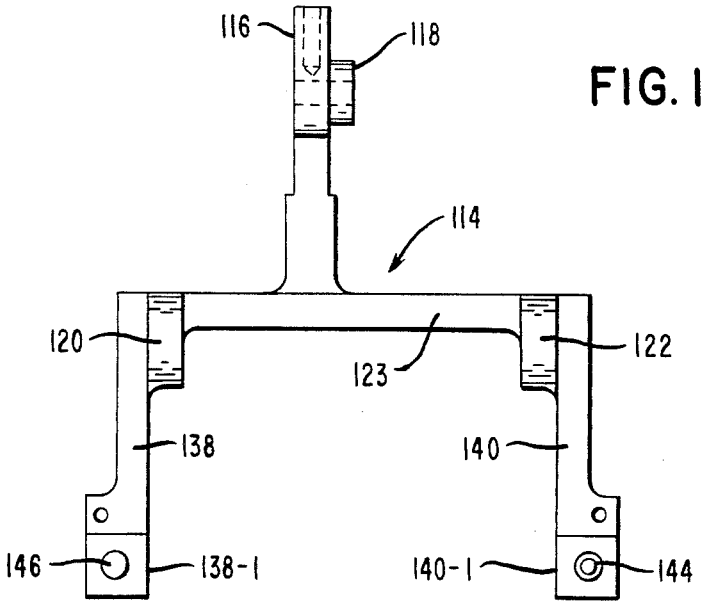
FIG. 11B
FIG. 11C
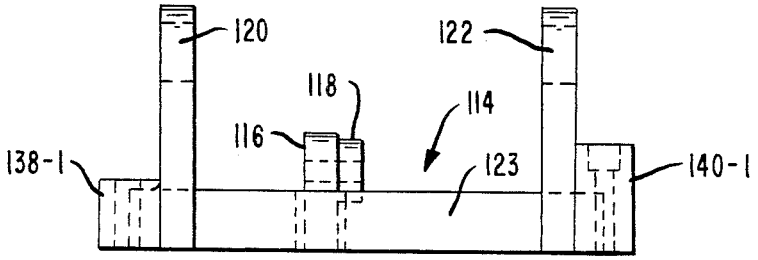

METHOD AND APPARATUS FOR THERMALLY PRINTING DATA IN SPECIAL FONTS ON DOCUMENTS LIKE CHECKS

BACKGROUND OF THE INVENTION

This invention relates generally to thermal printing, and more specifically, it relates to a method and apparatus for high-speed, non-impact, thermal printing which provides sufficient resolution to produce specific styles of fonts such as E13B, by the American Bankers Association; OCR-A and OCR-B, by Accredited Standards Committe X3; and CMC7, by Companie des Machines Bull for example, and also for printing on plain paper or documents like checks.

One problem with many prior-art, thermal printers is that they do not provide sufficient definition or resolution of the character printed when compared to laser-xerographic or ink jet technologies.

Another problem with prior-art, thermal printers is that they generally employ specialized thermal paper which has a limited shelf life and is not the record medium of choice for a large number of applications.

Another problem with some prior-art thermal printers is that they employ a feed mechanism which feeds the record medium in a continuous manner past the recording head; this type of feed mechanism is not suitable for printing on record media like checks or deposit slips, for example, where intermittent feeding of the record media to be printed upon is encountered.

Another problem is that some prior-art, thermal printers are not compact and adaptable enough to be incorporated in an encode and sort machine, for example, which is used for printing (in specific styles or fonts, like E13B, for example) on financial documents like checks, for example.

SUMMARY OF THE INVENTION

In a preferred embodiment of the invention, the thermal printing apparatus comprises a print station; means for positioning a record medium at said print station; and means for printing on a said record medium positioned at said print station; said means for printing comprising: an arculately-shaped platen; a line of printing elements; means for selectively energizing said printing elements in said line of printing elements; first means for mounting said platen for movement between printing and non-printing positions with regard to said print station; second means for mounting said line of printing elements for pivotal movement between first and second positions with regard to said print station and about a pivot point; and actuating means coupled to said first and second mounting means to move said platen from said non-printing position to said printing position, and thereafter to pivotally move said line of printing elements from said first position to said second position so as to maintain said line of printing elements in substantial tangential relationship with said platen.

This invention also includes a method of thermally printing data in association with a thermally responsive ribbon and a record medium at a print station, including an arcuately-shaped platen and using a line of printing elements, which said elements are selectively energizable, comprising the steps of: (a) positioning said record medium and ribbon at said print station in printing relationship with said line of printing elements and said platen by moving said platen into operative engagement with said line of printing elements; (b) energizing selected ones of said printing elements to effect at least partial printing of said data on said record medium; (c) pivoting said line of printing elements about the now stationary platen so as to present said line of printing elements to a portion of said record medium yet to be printed upon; (d) repeating steps b nd c as necessary to complete the printing of said data while maintaining said record medium stationary with respect to said platen; and (e) moving said record medium and said ribbon apart to facilitate peeling of said ribbon from said record medium.

An object of this invention is to provide a low-cost, low-noise, method and apparatus for printin9 alphanumeric characters in high resolution fonts such as the various fonts mentioned earlier herein, while printing on plain paper.

Another object of this invention is to produce a printer which is especially suitable for printing the courtesy or monetary amount, for example, on a document like a check in financial transaction machines.

Some advantages of the apparatus of this invention are that it is compact, quiet, and capable of printing in various stylized fonts. Another advantage is that the apparatus may use a thermal transfer ink ribbon which enables printing on plain paper. Special apparatus is included to separate the ribbon from the paper or document after printing. These advantages and others will be more readily understood in connection with the following description and drawing.

BRIEF DESCRIPTION OF THE DRAWING

FIG. 11A is a side view of a pivot lever shown in FIGS. 7–10, for example;

FIG. 11B is a plan view of the pivot lever shown in FIG. 11A;

FIG. 11C is an end view of the pivot lever shown in FIG. 11A;

DETAILED DESCRIPTION OF THE INVENTION

Figure 1A:
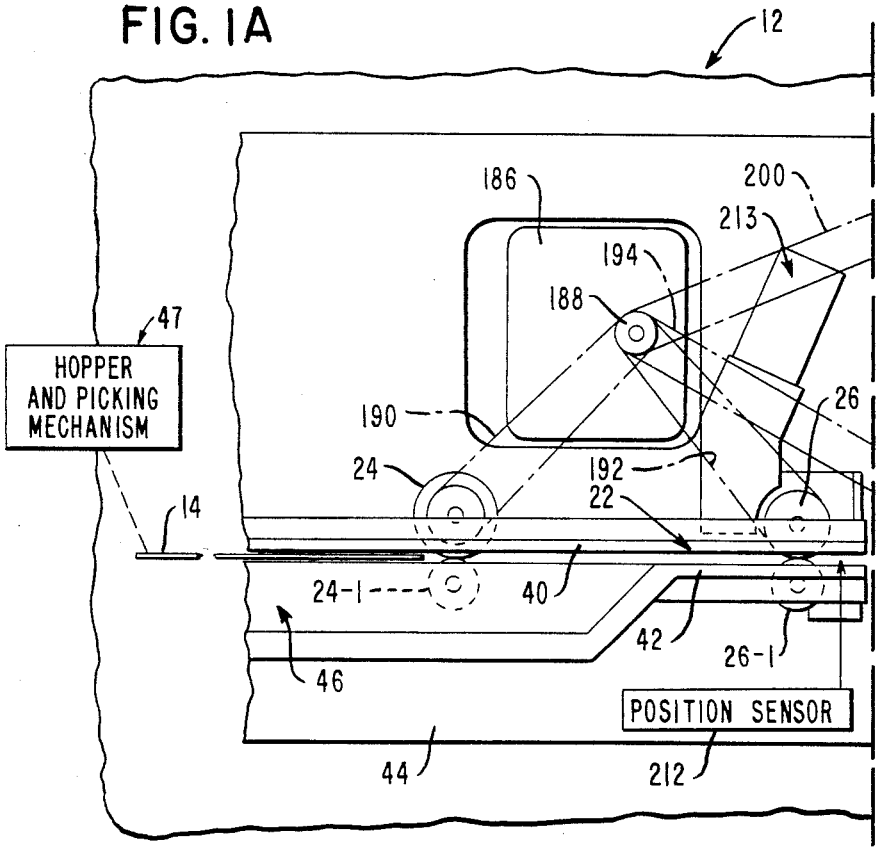
FIGS. 1A and 1B taken together are a plan view, in diagrammatic form, showing a preferred embodiment of this invention.
Figure 1B:
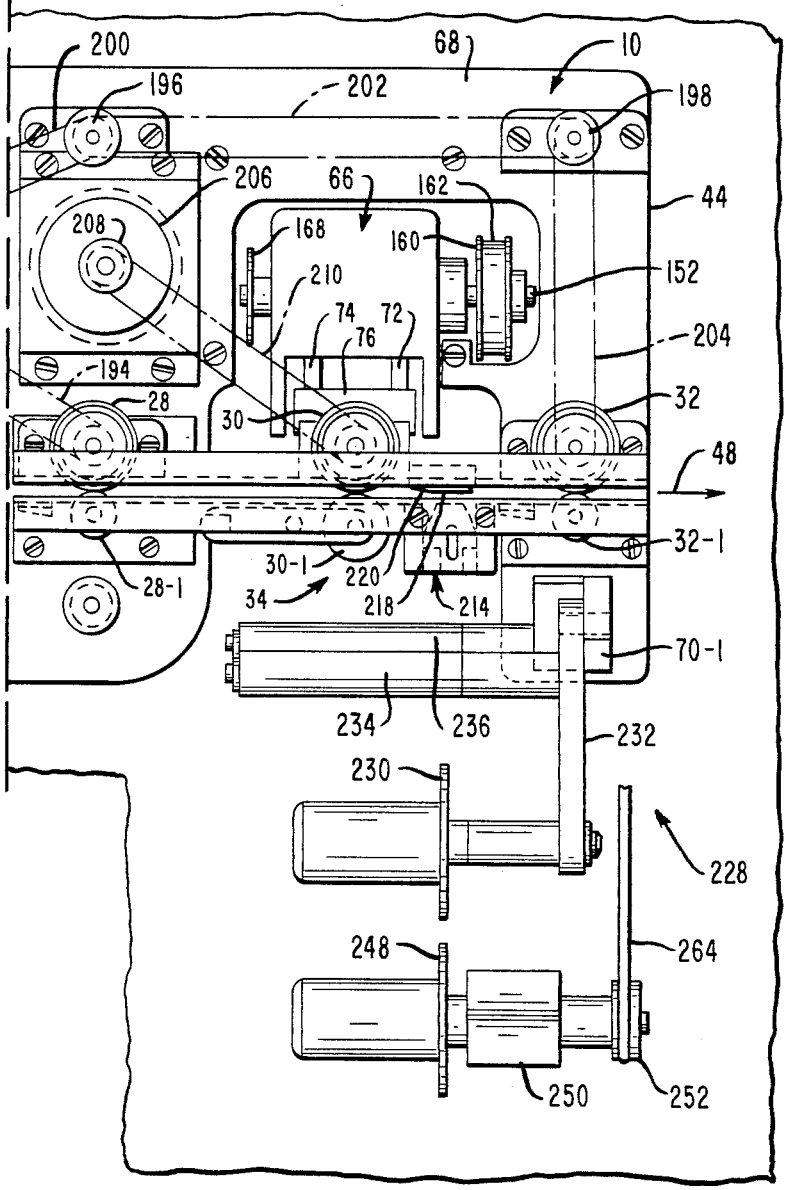

FIGS. 1A and 1B, taken together, show a plan view, in diagrammatic form of a preferred embodiment of the means for printing, or the printer module 10 of this invention as it is incorporated in a business machine such as an encode and sort unit, hereinafter referred to as encoder 12, with only a portion of the encoder 12 being shown. While the printer module 10 may be used in a variety of printing environments, the encoder 12 is useful to illustrate the advantages of the printer module 10.

Figure 2:
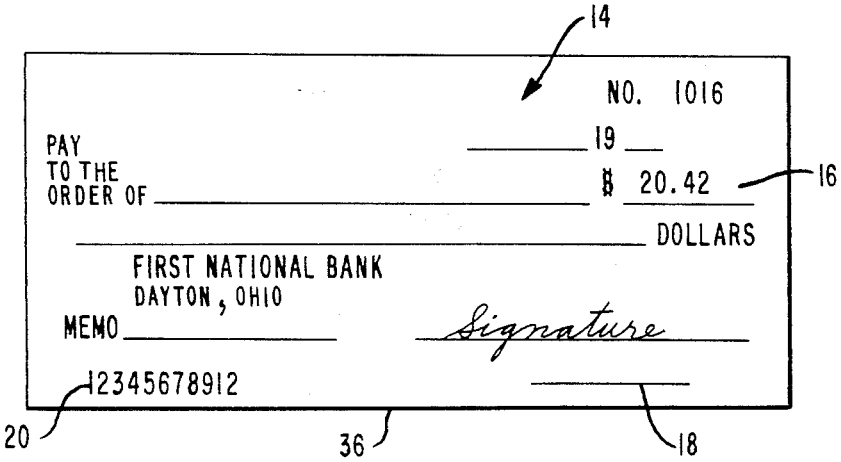
FIG. 2 is a plan view of a document like a check which may be printed upon by the printer module shown in FIGS. 1A and 1B.

As general background information, the encoder 12 is a machine which is used in the banking industry to process documents such as deposit slips and checks, for example, like check 14 shown in FIG. 2. During the processing of documents or checks at a bank, for example, a point is reached at which the monetary or courtesy amount 16 of the check 14 is printed on the check 14 itself. Generally, the associated courtesy amount 16 is printed on the check 14 under the signature along line 18. In the USA and a number of other countries, the checks have magnetic ink character recognition (MICR) data printed thereon according to an E13B font, for example. This MICR data 20 (shown only in regular print in FIG. 2) includes, for example, the account number, check number, and bank number.. In the embodiment described, the printer module 10 is utilized to print the courtesy amount 16 along line 18 of documents like check 14 in MICR ink and in a stylized font like E13B, for example. The printer module 10 can print on other fields of the check 14 by moving the check 14 at the print station 34.

The printer module 10 is shown generally in FIG. 1B so as to orient it in relation to the encoder 12. The encoder 12 (FIGS. 1A, 1B) includes a document track 22 and transport rollers such as 24, 26, 28, 30 and 32 which cooperate with associated pinch rollers 24-1, 26-1, 28-1, 30-1, and 32-1, respectively, to provide a means for moving a document like check 14 to a print station 34 and away therefrom. The top edge of the check 14 is seen in FIG. 1A, and it is fed on its lower edge 36 (FIG. 2), with the lower edge 36 gliding over the trough portion 38 (shown for example in FIG. 7) of track 22 which also includes the vertical side walls 40 and 42. These side walls 40 and 42 are secured to the frame 44 and are spaced apart to receive the documents therebetween and to guide a document like check 14 to the print station 34 (FIG. 1B) where the printer module 10 is located. The encoder 12 also includes a hand drop area 46 (FIG. 1A) to enable manual feeding of documents into the track 22. The printer module 10 is then utilized to print the courtesy amount 16, for example, on the associated check 14 as previously described. After printin9, the document 14 is moved from the print station 34 by drive rollers 30 and 32 and their associated pinch rollers 30-1 and 32 1, for example, and moved in the downstream direction shown by arrow 48 to further elements not important to an understanding of this invention.

Figure 3:
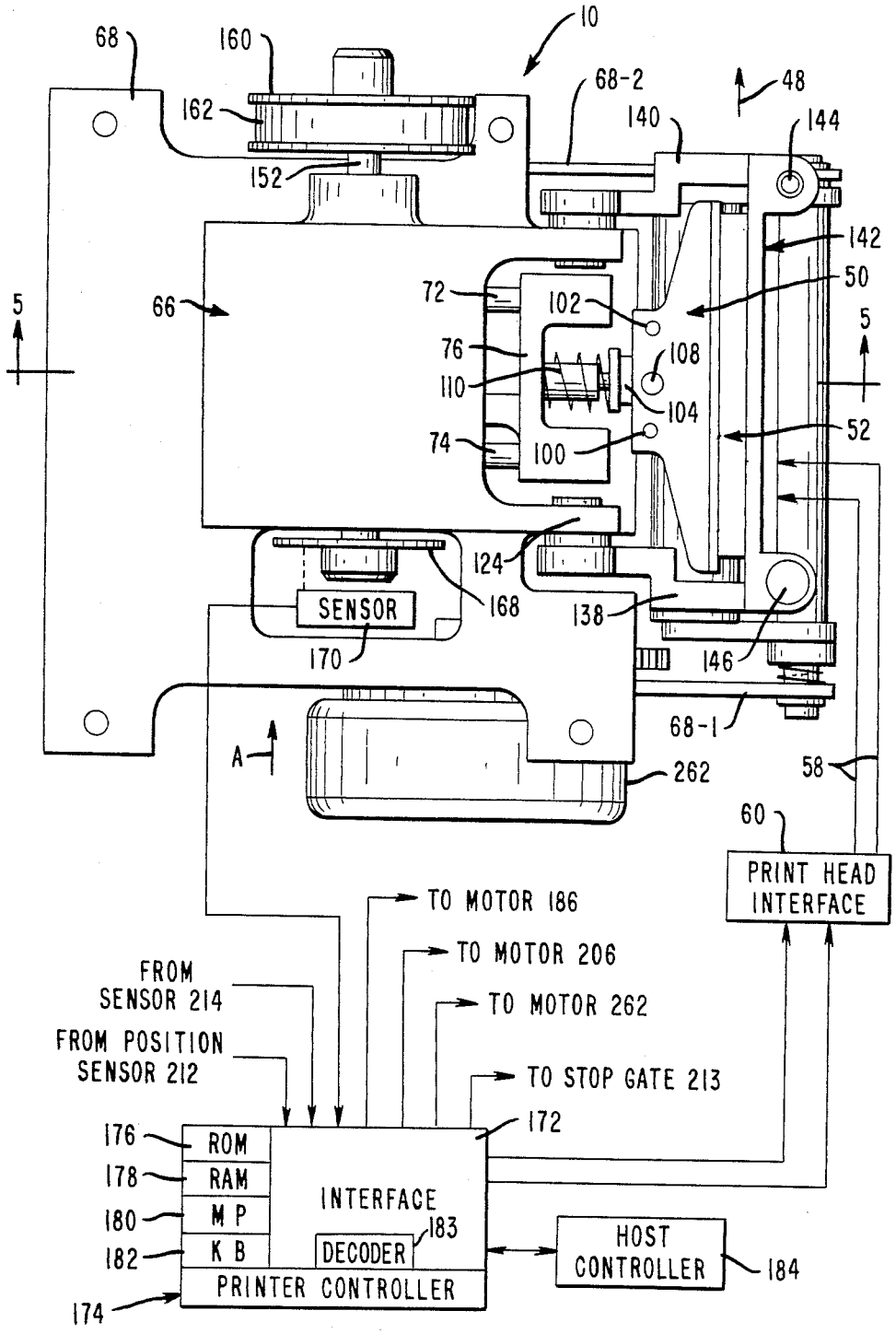
FIG. 3 is a plan view of the printer module when it is separated from the environment shown in FIG. 1B, and it also shows a schematic view of control electronics associated with the printer module.
Figure 4:
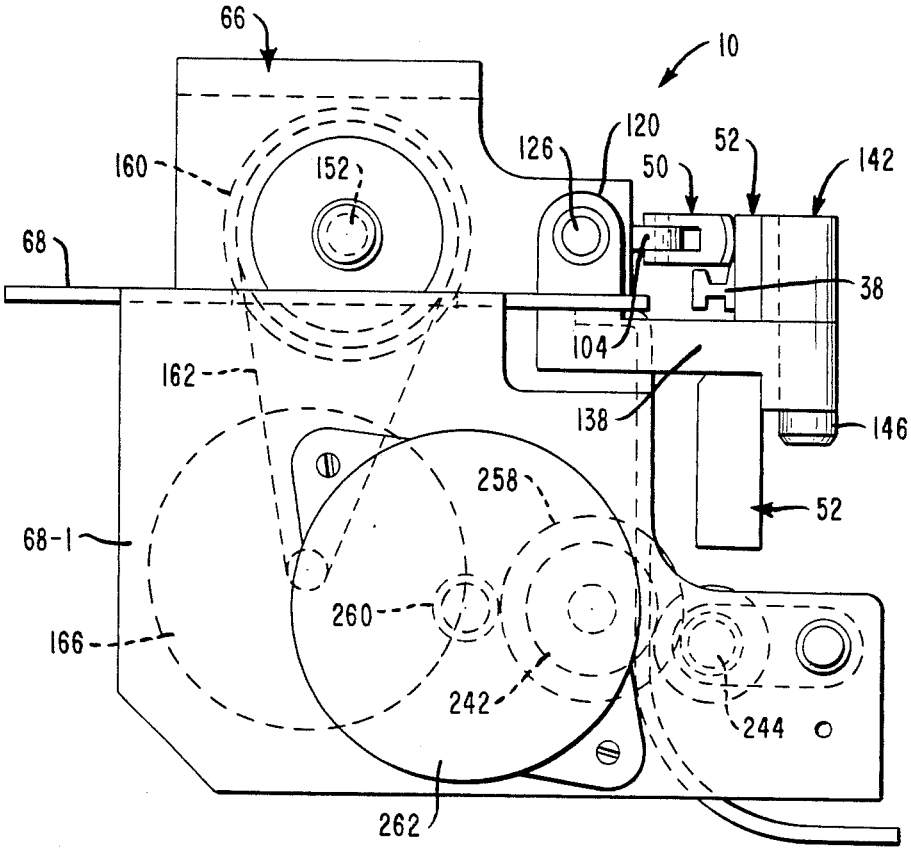
FIG. 4 is a side view, in elevation, of the printer module shown in FIG. 3, when looking in the direction of arrow A in FIG. 3.
Figure 5:
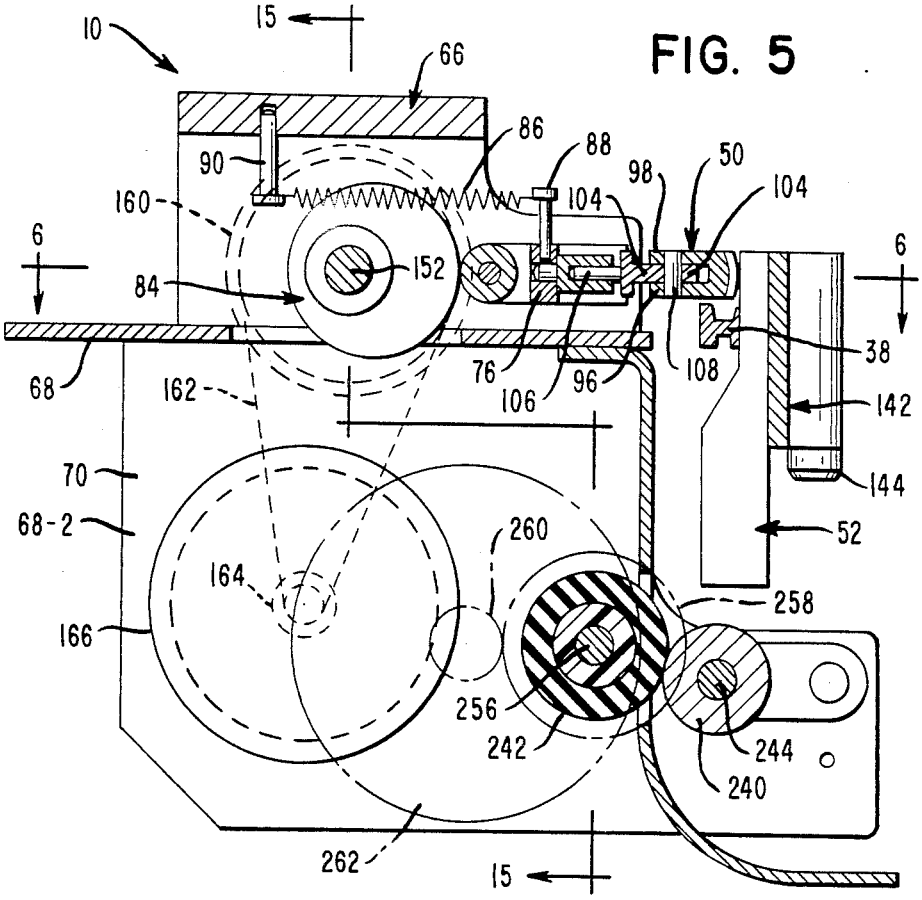
FIG. 5 is a cross-sectional view, taken along the line 5–5 of FIG. 3 to show additional details of the printer module.
Figure 7A:
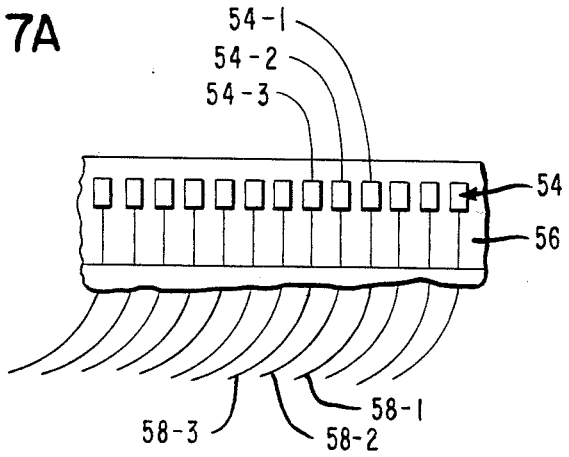
FIG. 7A is a view taken along the line 7A–7A of FIG. 7 to show additional details of a line of printing elements in the printer module.

The printer module 10, shown generally in combined FIGS. 1A and 1B, is shown in more detail in FIGS. 3, 4, 5 and 6, with the trough portion 38 of the document track 22 being shown in FIGS. 4 and 5, for example, to orient the reader. The means for printing at the printer module 10 includes a platen 50 and the print head 52. The print head 52 includes a line of discrete printing elements 54 (exaggerated in size and positioned on a ceramic print head support 56) as shown diagrammatically in FIGS. 7 and 7A, for example.

Each of the discrete printing elements like 54-1 (FIG. 7A), 54-2, and 54-3, for example, has its own energizing lead like 58-1, 58-2, and 58-3, respectively, connected to a conventional print head interface 60, shown in FIG. 3, with these energizing leads being shown collectively as 58 in FIG. 3. In the embodiment described, each discrete printing element like 54-1, for example, has a width (as viewed in FIG. 7A) of 145 microns and a height of 165 microns with a spacing between adjacent elements of 20 microns measured along the line of printin9 elements 54; this is equal to a printing density of 6.06 dots per millimeter as measured along the line of printing elements 54. For fonts like E13B and CMCT, for example, fourteen discrete printing elements like 54-1, 54-2, etc., are allocated to print the width of a character, with the width being measured horizontally as viewed in FIG. 7A, and eighteen indexing steps are allocated to present the line of printing elements 54 to a new area of the record medium like check 14, as by indexing vertically as viewed in FIG. 7A, to complete the height of a character. Thus, an individual character to be printed is printed within a 14×18 matrix; this matrix, having the printing density mentioned, permits printing in sufficient resolution to print in the various specialized fonts like E13B, for example, mentioned earlier herein.

The printer module 10 also includes an actuation means 62 (FIG. 7, for example) for providing relative movement between the line of printing elements 54 and the platen 50 so that the line of printing elements 54 is substantially in tangential relationship with the platen 50 to effect printing. The actuation means 62 for providing the relative movement is shown best in FIGS. 7, 8, 9 and 10. Certain portions of the printer module 10 are left out of the FIGS. 7–10, to simplify these figures.

Figure 7:
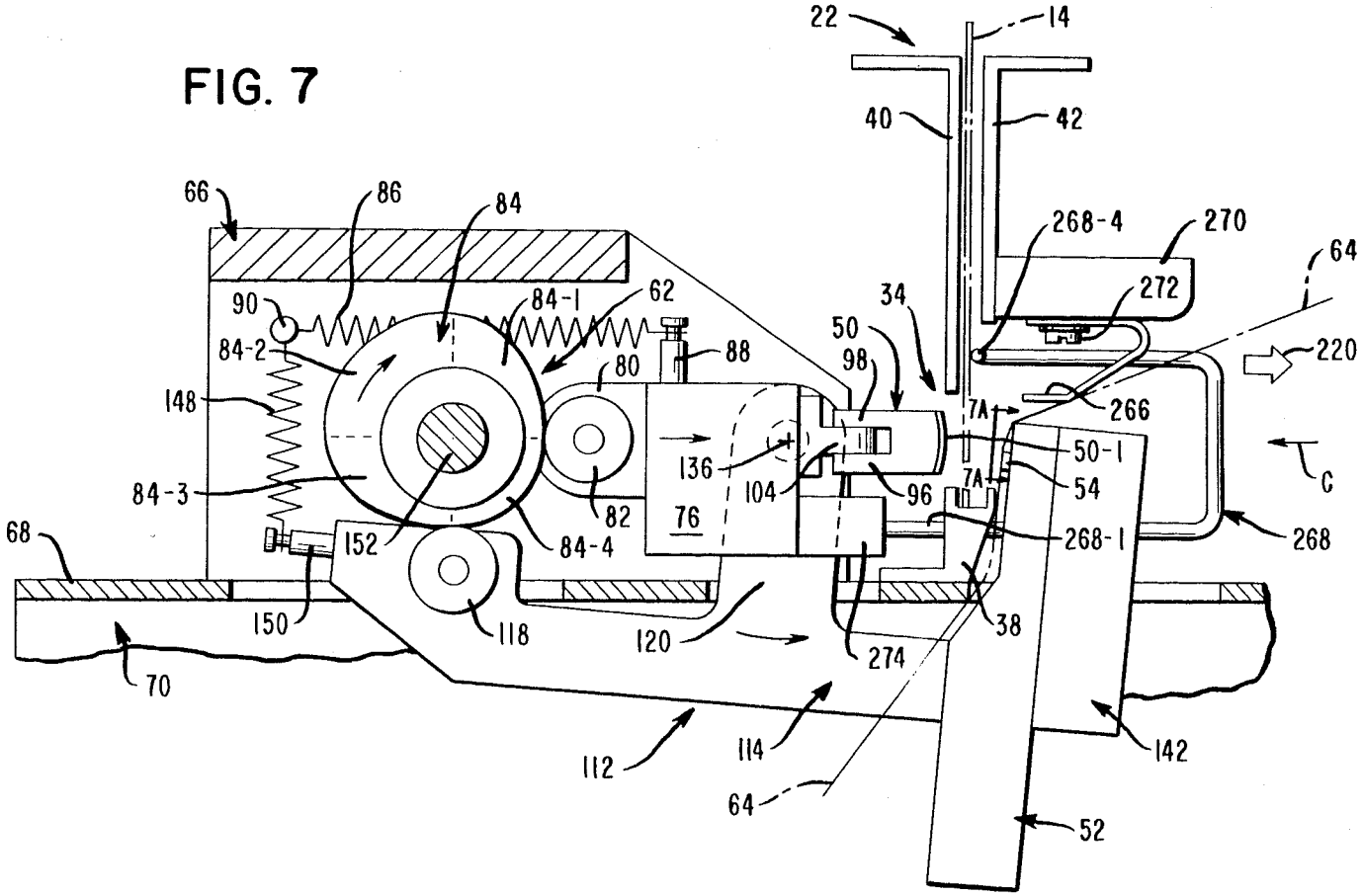
FIG. 7 is a view similar to FIG. 5 in orientation; however, certain details are eliminated to simplify the drawing, and it is used to show the print module in a home position.

FIG. 7 shows the actuation means 62 in a home position in which the line of printing elements 54 is spaced from the platen 50 to permit the insertion of a record medium like check 14 therebetween.

Figure 8:
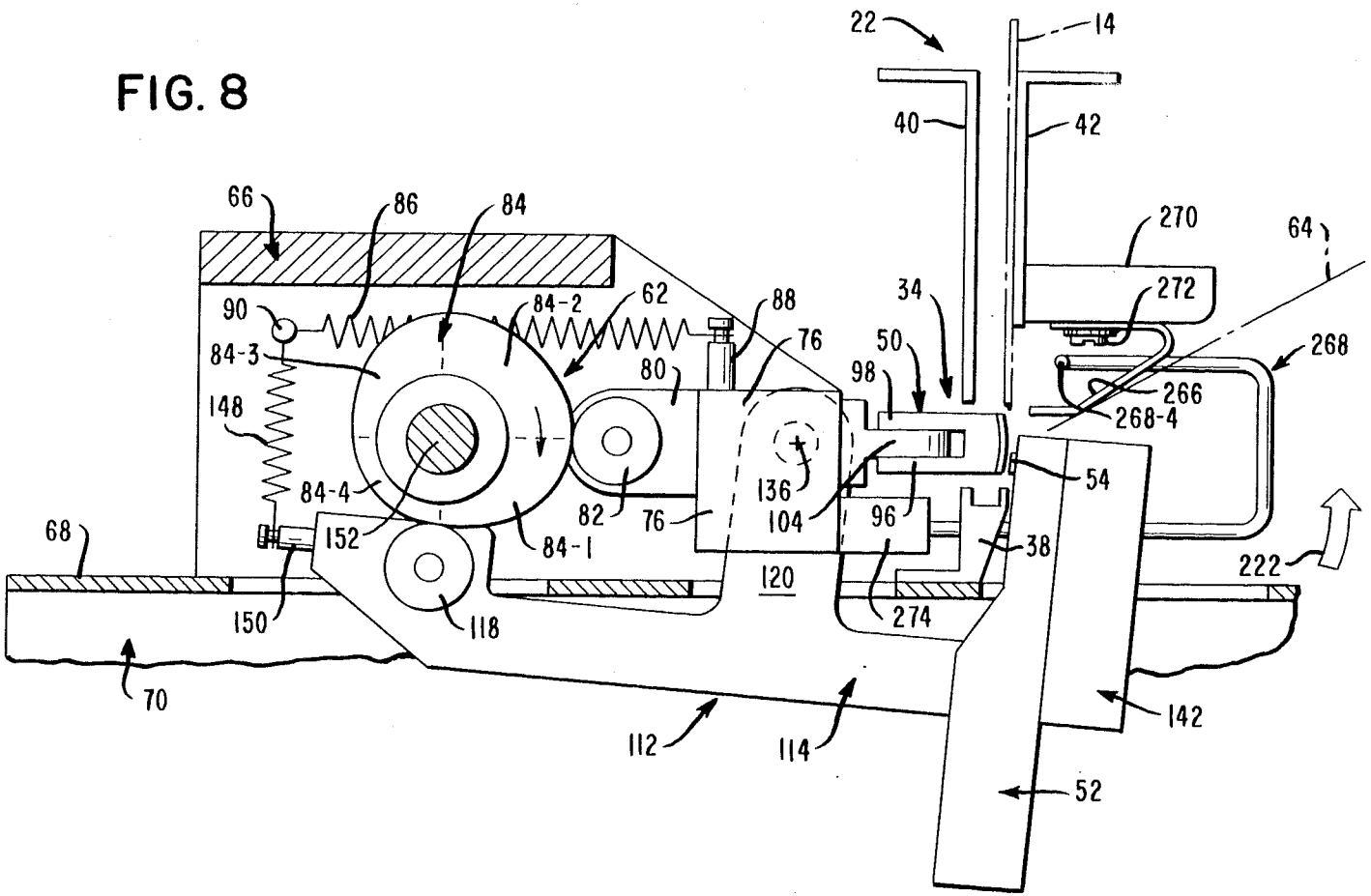
FIG. 8 is a view similar to FIG. 7 in orientation, and it is used to show the platen and print head (containing a line of printing elements) in operative printing relationship with each other.

FIG. 8 shows the actuation means 62 at the start of the printing operation in which the line of printing elements 54 is just about in operative relationship with the platen 50.

Figure 9:
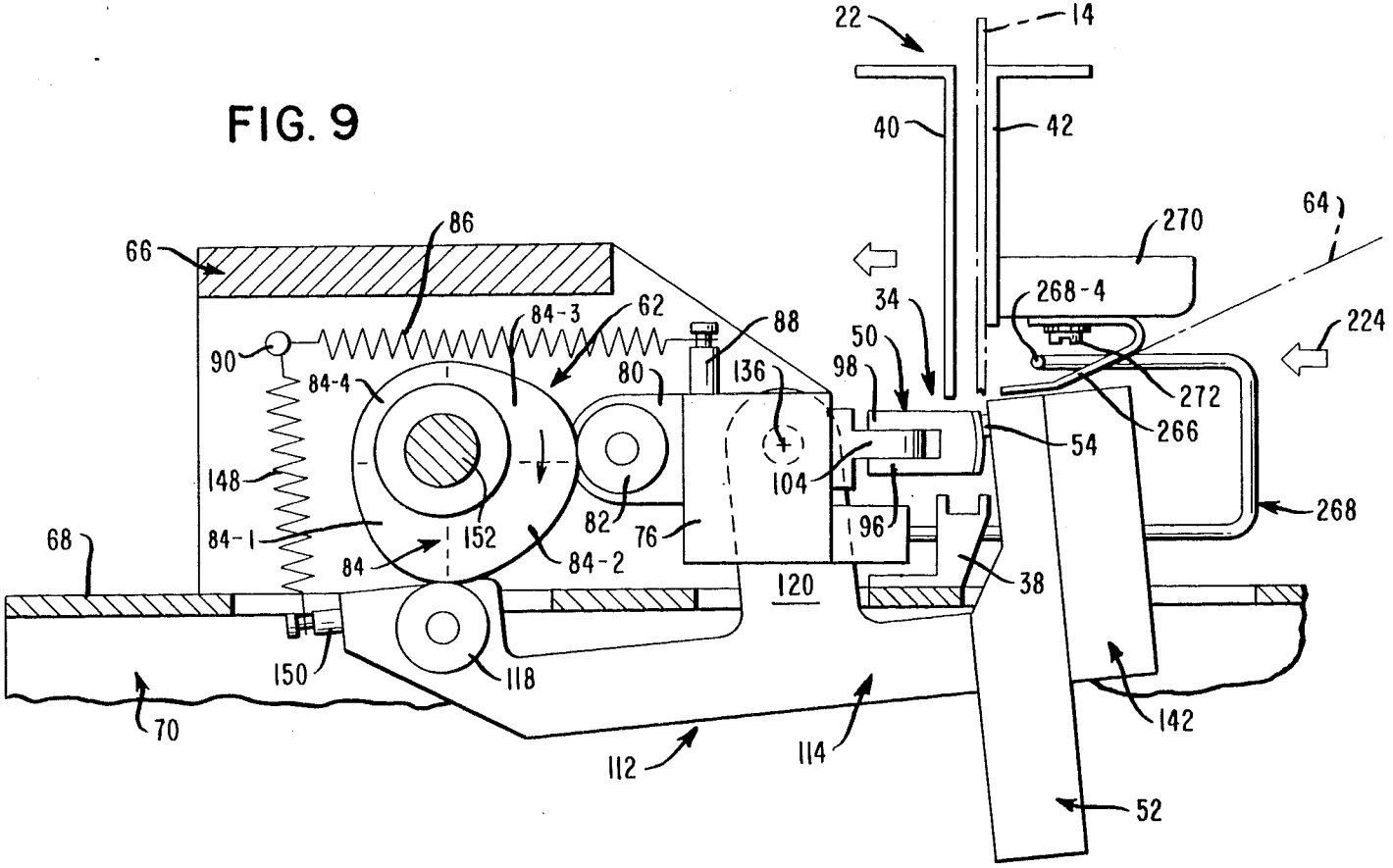
FIG. 9 is a view similar to FIG. 7 in orientation, and it is used to show the print head at the end of a print cycle.

FIG. 9 shows the actuation means 62 at the finish of the printing operation.

Figure 10:
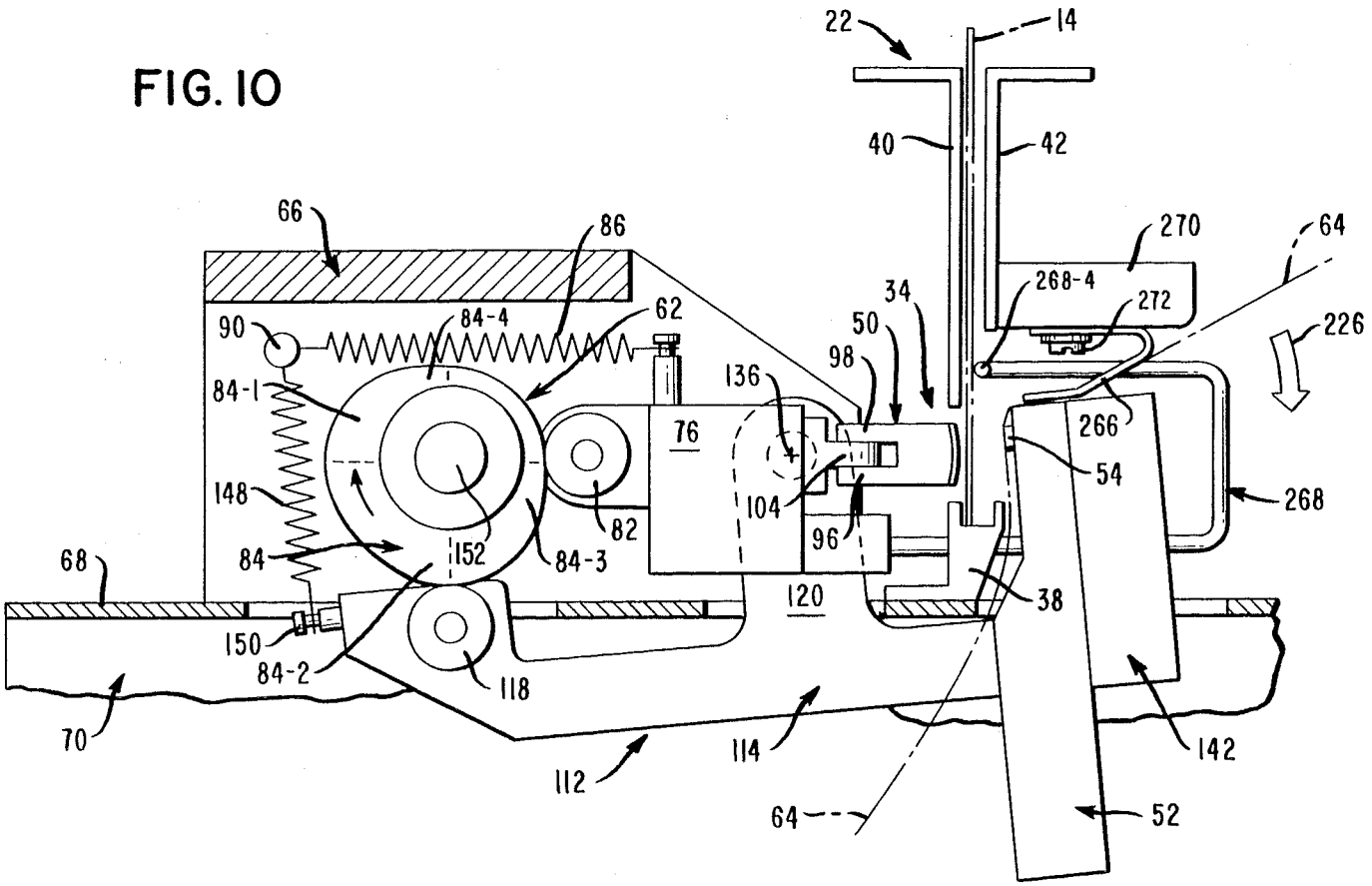
FIG. 10 is a view similar to FIG. 7 in orientation, and it is used to show the platen being moved away from the print head.

FIG. 10 shows a retracted platen 50 and also shows the actuation means 62 in the process of returning to the home position. A record medium 14 and a ribbon 64 are shown only schematically in order to simplify the FIGS. 7–10.

Before discussing the actuation means 62 alluded to in FIGS. 7–10, it appears appropriate to discuss some of the structure of the printer module 10.

Figure 6:
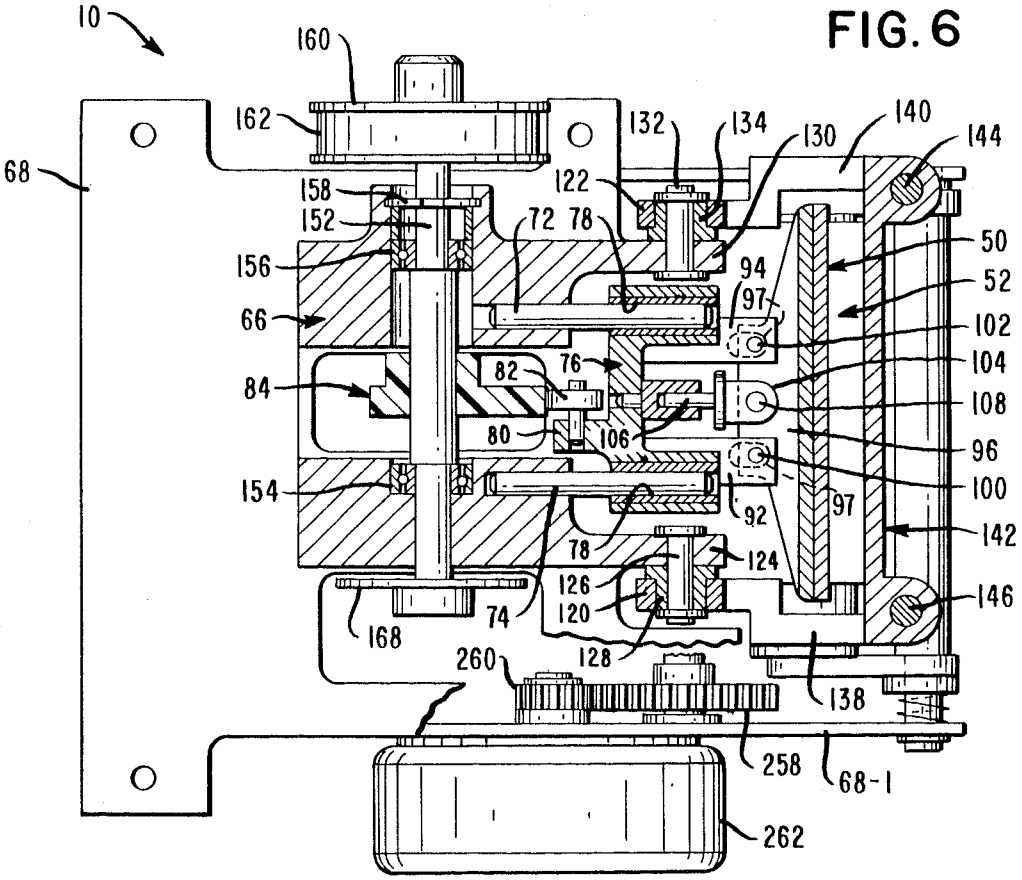
FIG. 6 is a cross-sectional view, taken along the line 6–6 of FIG. 5, to show additional details of the printer module.

The printer module 10 includes a means for moving the platen 50 from the home position shown in FIG. 7 to the printing position shown in FIG. 8, for example. This moving means includes a support member 66 which is secured to a plate 68 which is part of the general frame 70. The support member 66 has two spaced rods 72 and 74 extending therefrom as shown best in FIG. 6. A slide member 76 (with suitable sleeve bearings 78 therein) is slidably mounted on the spaced rods 72 and 74 to enable the slide member 76 to be reciprocated in a horizontal direction (as viewed in FIG. 7 for example) by the actuation means 62. The slide member 76 has a portion 80 (FIG. 7) extending therefrom on which portion a cam follower 82 is rotatably mounted. The cam follower 82 is kept in operative engagement with the periphery of the driving cam 84 (which is part of the actuation means 62) by a tension spring 86 having one end secured to a post 88 on the slide member 76 and the remaining end thereof secured to a post 90 secured to the support member 66 as shown best in FIG. 5. The support member 66 also has flat portions 92 and 94 extending therefrom as shown in FIG. 6. The platen 50 has two spaced flat planar areas 96 and 98 (FIG. 5) to receive the flat portions 92 and 94 therebetween. These flat areas 96 and 98 have elongated slots therein like slots 97 in flat area 96 enable the pins 100 and 102 (FIG. 6) to pass therethrough and to retain the platen 50 connected to the slide member 76. The elongated slots in flat areas 96 and 98 enable the platen 50 to be reciprocated slightly between the print head 52 and the driving cam 84 to establish printing contact with the printing elements 54. A plunger member 104, having a rod 106 thereon, is pivotally joined to the center of p1 aten 50 by a pin 108 as shown best in FIG. 6. The rod 106 is slidably mounted in the slide member 76, and a compression spring 110 (shown in FIG. 3) is used to resiliently urge the platen 50 against the print head 52 to establish the printing load while the print head 50 can also pivot about pin 108. The platen 50 is retained on the support member 76 by the pins 100 and 102 (FIG. 6) passing through the elongated slots in the flat areas 96 and 98 mentioned. By this construction, the platen 50 pivots (about pin 108) and moves only in a horizontal plane, as viewed in FIG. 5, to enable accurate alignment of the platen 50 and the line of printing elements 54 during printing and to enable equal platen pressure therebetween during printing.

Having described the movement of the platen 50 between the non-printing and printing positions with regard to the print station 34, it appears appropriate to discuss the means 112 (FIG. 7, for example) for mounting the line of printing elements 54 for pivotal movement between first and second positions at the print station 34.

Figure 12A:
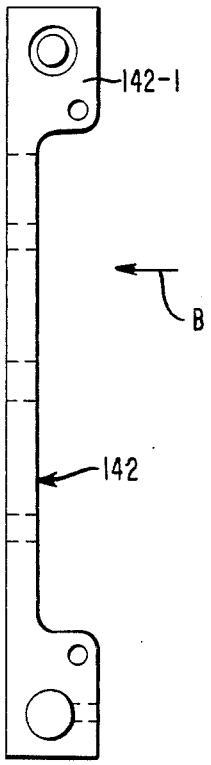
FIG. 12A is a top view of a plate on which the printing head is mounted.
Figure 12B:
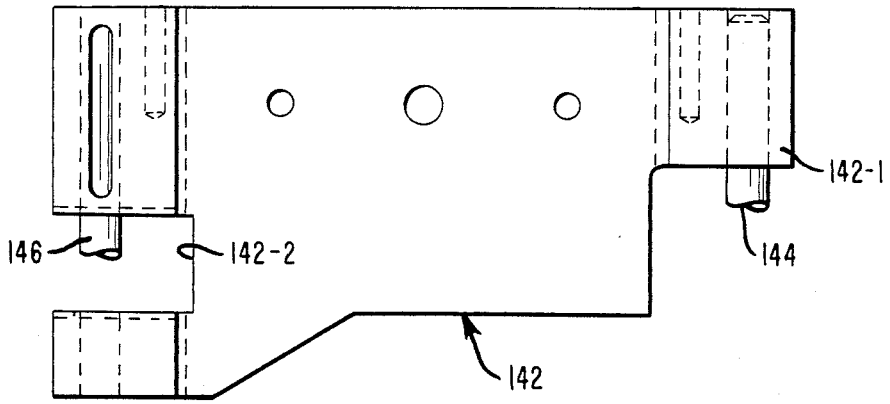
FIG. 12B is an end view, taken from the direction of arrow B of FIG. 12A to show additional details of the end plate shown in FIG. 12A.

The means 112 includes, basically, the pivot lever designated generally as 114 and shown in general outline in FIGS. 7–10 and shown in more detail in FIGS. 11A, 11B and lIC. The pivot lever 114 includes a central arm 116 having a cam follower 118 rotatably mounted thereon and positioned to engage the periphery of the driving cam 84. The pivot lever 114 also has spaced arms 120 and 122 with the arm 120 being pivotally supported in a lateral support 124 of the support member 66 by a fastener 126 and bushing 128 as shown in FIG. 6. The opposite spaced arm 122 is similarly supported in a lateral support 130 of the support member 66 by a fastener 132 and a bushing 134. The arms 120 and 122 are joined by a cross member 123 (FIG. 11B) which is secured to the central arm 116. The longitudinal axes of fasteners 126 and 132 are coincident with each other and provide a pivot axis 136 (FIG. 7, for example) for the pivot lever 114. The pivot lever 114 also has arms 138 and 140 (FIGS. 6 and 11B) which support a plate 142 on which the print head 52 is adjustably mounted. The plate 142, shown in more detail in FIGS. 12A and 12B, is pivotally mounted on the offset arm 140 by a pin 144 (FIG. 6) to enable the plate 142 to pivot about pin 144 in a counterclockwise direction, as viewed in FIG. 6, to move the plate 142 and the print head 52 thereon out of the way so as to facilitate the insertion of the ribbon 64. After the plate 142 and the print head 52 are moved into the position shown in FIG. 6, a removable locking pin 146 is used to secure the print head 52 to the pivot lever 114.

The end plate 142 is shown in more detail in FIGS. 12A and 12B. The extension 142-1 fits over the end 140-1 (FIG. 11C) of arm 140, and the extension 138–1 of arm 138 fits into the notched out areas 142-2 of the plate 142. The pins 144 and 146 alluded to earlier are shown positioned in the plate 142 (FIG. 12B). By the construction described, the pivot lever 114 is pivotally supported by the spaced arms 138 and 140 which construction provides horizontal and vertical stability to the line of printing elements 54 on the print head 52. Also, because the platen 50 pivots about its center (via pin 108) and is constrained to pivot in a plane which includes the line of printing elements 54, the accuracy of thermal printing by the printer module 10 is increased when compared to some prior-art constructions. The pivot lever 114 is resiliently biased to pivot in a clockwise direction (as viewed in FIG. 7) about the axis 136 by a tension spring 148 having one end thereof secured to a fastener 150 on the pivot lever 114 and the remaining end thereof secured to a stationary post 90 (FIG. 5), with the post 90 being shown schematically in FIGS. 7–10.

The actuation means 62, alluded to earlier herein, includes the drive cam 84 which is fixed to rotate with the rotating shaft 152 which is shown best in FIG. 6. The shaft 152 is rotatably supported in bearings 154 and 156 which are located in the support member 66, and the shaft 152 is axially restrained therein by a suitable "C"-type washer or circlip 158. The shaft 152 is rotated by a pulley 160 (FIG. 1B) which is incrementally rotated or indexed by a timing belt 162 which is coupled to the output pulley 164 (FIG. 5) of a stepping motor 166 which is secured to the frame 70 of the printer module 10. One complete rotation of the pulley 160 rotates the cam 84 through 360 degrees, and one complete revolution of the cam 84 causes the platen 50 and print head 52 to move from their home positions shown in FIG. 7 through the various positions shown in FIGS. 8–10 and back to the home position shown in FIG. 7.

The driving cam 84 (FIGS. 7–10) is divided into four equal sectors, namely, a rise sector 84-1, a first dwell sector 84-2, a fall sector 84-3, and a second dwell sector 84-4, with the first dwell sector 84-2 having a radius larger than the radius of the second dwell sector 84-4. The peripheries of the sectors 84-1, 84-2, 84-3 and 84-4 are blended into one another so as to provide a smooth continuous camming action as the cam 84 is rotated.

Before discussing the operation of the driving cam 84, it appears appropriate to discuss some additional elements associated with the printer module 10 and the encoder 12.

The platen 50 is made of steel and has a cast urethane surface 50-1 of about 0.100 inch in thickness bonded thereon as shown in FIG. 7, for example. The radius of curvature of the surface 50-1 has its center located at the axis 136 when the platen 50 is in operative engagement with the line of the printing elements 54 as shown in FIG. 8. When the pivot lever 114 and the print head 52 incrementally pivot during printing from the position shown in FIG. 8 to the position shown in FIG. 9, the line of printing elements 54 is in substantial tangential relationship with the surface 50-1 of the platen 50.

The printer module 10 also includes a slotted timing disc 168 (FIG. 3), which is fixed to shaft 152 to rotate therewith, and a conventional light and photocell sensor 170 is used to indicate the home position of the printer module 10. The output of the sensor 170 is fed through the interface 172 of a printer controller 174.

The printer controller 174 (FIG. 3) is conventional and does not form a part of this invention. The necessary instructions for operating the printer module 10 may be stored in the read only memory (ROM) 176), or they may be loaded daily into the random access memory (RAM) 178 from some supplemental storage like a tape or disc file (not shown). A microprocessor (MP) 180 is used to process the instructions, and a keyboard (KB) 182 is used to make selections as to type of font to be used and to control the printer module 10. The print head interface 60 is conventional and contains the necessary drivers to supply the energizing currents to the print head 52. The interface 172 is used to provide interconnections among the various components shown and also to interface the printer module 10 with the host controller 184 associated with the encoder 12 or some host system (not shown).

The encoder 12 (FIGS. 1A and 1B) also includes a motor 186 having a tandem-type, driving pulley 188 to rotate the transport rollers 24, 26, 28 and 32 previously alluded to. Transport roller 24 is operatively coupled to the driving pulley 188 by a belt 190 (shown as a dashed line); transport roller 26 is similarly driven by a belt 192; transport roller 28 is similarly driven by a belt 194; and transport roller 32 is rotated by the combination of pulleys 196, 198, and the belts 200, 202 and 204.

The printer module 10 also includes a second motor 206 (FIG. 1B) having a driving pulley 208 and belt 210 which are used to rotate the drive roller 30. The transport rollers 24, 26, 28 and 32 are what are considered "soft drives" in that the coefficient of friction of these rollers 24, 26, 28, 32 is low so as to permit these rollers 24, 26, 28, 32 rotate while the check 14 is held stationary at the print station 34 (by roller 30 and motor 206) without excessive "scrubbing" or abrading of the portions of the check 14 in contact with these rollers 24, 26, 28, 32. The transport roller 30 is considered a "hard drive" in that it has a coefficient of friction higher than that of the transport rollers 24, 26, 28 and 32 so as to permit roller 30 in association with motor 206 to provide a positive, no-slip drive to hold the, check 14 stationary at the print station 34 and to control the movement of the check 14 through the print station 34. This construction permits printing in more than one area of a check 14, for example.

As a check 14 approaches the printer module 10, a conventional position sensor 212 shown schematically in FIG. 1A is used to detect the leading edge of the check 14, and the corresponding signal is forwarded to the printer controller 174 (FIG. 3). The encoder 12 also includes a conventional stop gate 213 which is also under the control of the printer controller 174. The stop gate 213 physically stops a document in the track 22 so as to provide a staging area for documents to be printed upon. It permits a document 14 to be held at the stop gate 213 (if necessary) until the prior document is removed from the print station 34; this is especially useful when documents are fed at asynchronous rates by the manual feeding of documents at the hand drop area 46 (FIG. 1A). The encoder 12 typically has a loading hopper and picking mechanism 47 for mechanically feeding the documents like check 14 along the track 22.

As the position sensor 212 (FIG. 1A) indicates the leading edge of a check 14, the printer controller 174 energizes the motor 206 (FIG. 1B) causing it to rotate transport roller 30 having its associated pinch roller 30-1 spring biased thereagainst. The transport roller 30 is of the same diameter as the other transport rollers 28 and 32, for example; however, the transport roller 30 is rotated at a speed lower than that of rollers 28 and 32. In the embodiment described,.the rollers 24, 26, 28 and 32 are rotated so as to provide a linear velocity of about 104 inches per second for a check 14 travelling in the document track 22, with a linear velocity of about 87 inches per second being provided by transport roller 30 which also has the higher coefficient of friction mentioned. In essence, the transport roller 30 is used to decelerate and stop and hold the check 14 at the print station 34 and to move it at the print station 34 when more than one sequence of printing is desired. As the check 14 is decelerated by transport roller 30, its leading edge reaches the position sensor 214 (FIG. 1B). The position sensor 214 is conventional and coacts with a mirror 218 the position sensor 214 and mirror 218 which are positioned on opposite sides of the track 22. A wedge or ramp 220 is used to minimize the collection of dust around the mirror 218. When the leading edge of a check 14 is detected by the position sensor 214, the printer controller 174 stops the stepping of the motor 206 to thereby position the check 14 at the print station 34. The motor 206 (FIG. 1B) remains energized during the time that printing is effected at the print station 34 to hold the document 14 stationary during printing. When printing in addition to that at line 18 (FIG. 2) on a check 14 is required, the motor 206 is stepped to move the check 14 further downstream in the document track 22 to present the next area (as at data 20) of the check 14 for printing. When printing is completed, the printer controller 174 steps the motor 206 to move the check 14 out of the print station 34 there the transport rollers like 32 move it downstream along the direction of arrow 48.

Having discussed the details of the components of the encoder 12 and the printer module 10, it appears appropriate to discuss the operation of both. As earlier stated, the function of the printer module 10 in the embodiment described is to print at least the courtesy amount 16 (FIG. 2) of a check 14 on line 18 thereof. Naturally, additional data may be printed on the check 14 by advancing the check 14 at the print stat.:on via the motor 206 and transport roller 30, as previously described. The data to be printed on line 18 of a check 14 may be obtained from the host controller 184, for example, and forwarded to the printer controller 174 (FIG. 3). If the data, to be encoded or printed is to be printed in an E13B font, for example, a heat transfer ribbon 64 containing the appropriate magnetic ink would be loaded in the printer module 10. An operator then selects the E13B font on the keyboard 182 (FIG. 3) and the appropriate decoder 183 is selected by the printer controller 174 to translate the data to be printed into the necessary energizing pattern to energize the line of printing elements 54 via the interface 60 to effect the printing. In the embodiment described, the printer module 10 prints up to sixteen characters on line 18 (FIG. 2), with four of the sixteen characters relating to the "transit routing" associated with checks, and with the remaining twelve positions relating to the courtesy amount 16 and its associated characters like amount symbols. The line of printing elements 54 is energized so as to complete the "matrix of dots" associated with the line 18 of characters by starting from the bottoms of the characters on a line of characters and by working towards the tops of the characters on the line.

When the printing operation is to start, a document like 14 is fed along the track 22 (FIGS. 1A and 1B), detected by the position sensor 212, and stopped in printing relationship with the print head 52 and platen 50 as previously described. At this time, the transport rollers 24, 26, 28 and 32 continue to rotate and may produce some slight "scrubbing action" on the back of the associated check 14; however, the check 14 is held at the printer module 10 by the transport roller 30, its associated pinch roller 30-1, and the holding action of stepping motor 206.

With the check 14 in position, the stepping motor 166 (FIG. 4) is energized in stepping fashion by the printer controller 174. The stepping motor 166 then begins to incrementally rotate the drive cam 84 in a clockwise direction as viewed in FIGS. 7–10 as previously explained. In the embodiment described, the stepping motor 166 is stepped, incrementally, 144 times in order to effect one complete revolution of the drive cam 84, although this number may be changed for different applications.

Starting with the line of printing elements 54 and the platen 50 in the home position shown in FIG. 7, the first 36 of the 144 indexes mentioned incrementally rotate the cam 84 through 90 degrees of rotation to the approximate position shown in FIG. 8. In FIG. 8, the line of printing elements 54, the ribbon 64, the document like check 14, and the platen 50 are brought into operative engagement. When the cam 84 rotates from the position shown in FIG. 7, the rise sector 84-1 of the cam 84 pushes the follower 82 and the platen 50 to the right as viewed in FIG. 7. Also, during the first 36 indexes mentioned, the second dwell sector 84-4 engages the follower 118 and produces a dwell; in other words the pivot lever 114 is not pivoted. The motion of the platen 50 during the first 36 indexes mentioned is represented by arrow 220 in FIG. 13 which figure represents an exaggerated "trace" of the motion of line of printing elements 54 and the platen 50.

Figure 13:
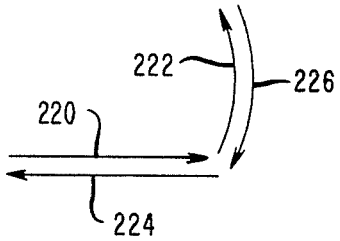
FIG. 13 (shown on the same sheet as FIG. 4) is a diagrammatic view of the motion of the line of printing elements and the platen shown in FIGS. 7–10.

During the second group of 36 indexes out of the 144 indexes mentioned for a complete revolution of the cam 84 (FIGS. 7–10), the line of printing elements 54 travels in an arcuate plane represented by arrow 222 in FIG. 13. The axis 136 for the line of printing elements 54 is the longitudinal axis of the fastener 126 (FIG. 6), for example. The curvature of the platen 50 is designed so that it has the same radius of curvature as the motion of the line of printing elements 54 when they are in operative engagement with the platen 50. To effect the motion indicated by arrow 222 in FIG. 13, the rise sector 84-1 of the cam 84 engages the follower 118 to pivot the pivot lever 114, about the axis 136, in a counterclockwise direction as viewed in FIG. 8. During this second group of 36 indexes, the first dwell sector 84-2 engages the follower 82 to keep the platen 50 in engagement with the line of printing elements 54. Also, during the first 9 indexes of the second group of 36 indexes, no printing takes place; during the next 18 indexes, printing takes place; and during the last 9 indexes, no printing takes place. It should be recalled that in the specific embodiment described, an individual character is formed in a 14×18 matrix of "dots" which means that 18 equal steps or indexes are required to complete the printing of one line of data. The first 9 and the last 9 indexes of the second group of 36 indexes are utilized for general preparation to allow the line of printing elements 54 and the platen 50 "to settle" and insure good operative contact prior to energization of the line of printing elements 54 for printing. The printing elements like 54-1, 54-2, etc. (FIG. 7A) of the line of printing elements 54 are then selectively energized to print the character patterns desired, and the heated elements like 54-1 transfer the thermal ink (like MICR). from the ribbon 64 to the check 14 in the desired pattern. After a momentary "cooling" period for the elements like 54, the pivot lever 114 is indexed one position by the rotation of driving cam 84, and the process described is repeated seventeen more times in the embodiment described.

During the third group of 36 indexes out of the 144 indexes mentioned for a complete revolution of the cam 84, the platen 50 travels in the direction represented by arrow 224 in Fi.. 13. To effect this motion, the fall sector 84-3 of cam 84 is in operative engagement with follower 82 (FIG. 9) due to the urging of spring 86 which effectively pulls the platen 50 to the left as viewed in FIG. 9; there is no pivoting of pivot lever 114 at this time because the first dwell sector 84-2 is in engagement with the follower 118.

During the fourth group of 36 indexes out of the 144 indexes mentioned for a complete revolution of cam 84, the line of printing elements 54 travels in the direction represented by arrow 226 in FIG. 13. To effect this motion, the fall sector 84-3 of cam 84 engages the follower 118, permitting the spring 148 to pivot the pivot lever 114 about the axis 136 in a clockwise direction as viewed in FIG. 10 to return the line of printing elements 54 to the home position shown in FIG. 7. In the home position, the rise sector 84-1 of cam 84 and spring 86, and the fall sector 84-3 and spring 148 tend to keep the platen 50 and the "L"-shaped lever 114 "detented" in the home position.

After the cam 84 is incrementally indexed 144 times to effect one complete revolution thereof, the line of printin9 on line 18 (FIG. 2) of the check 14 is completed. The printer controller 170 then energizes the motor 206 to rotate the transport roller 30 which moves the check toward the transport roller 32 to move the check 14 downstream along the direction of arrow 48.

One of the problems associated with some prior-art, thermal printers is that there is a tendency for the associated thermal ribbons to "stick" to the documents being printed upon.

The printer module 10 has a ribbon-handling mechanism 228 (FIG. 14) which supplies the ribbon 64 (alluded to earlier herein) to the print station 34 and also facilitates the separation of the ribbon 64 from the document or check 14 after printing.

Figure 14:
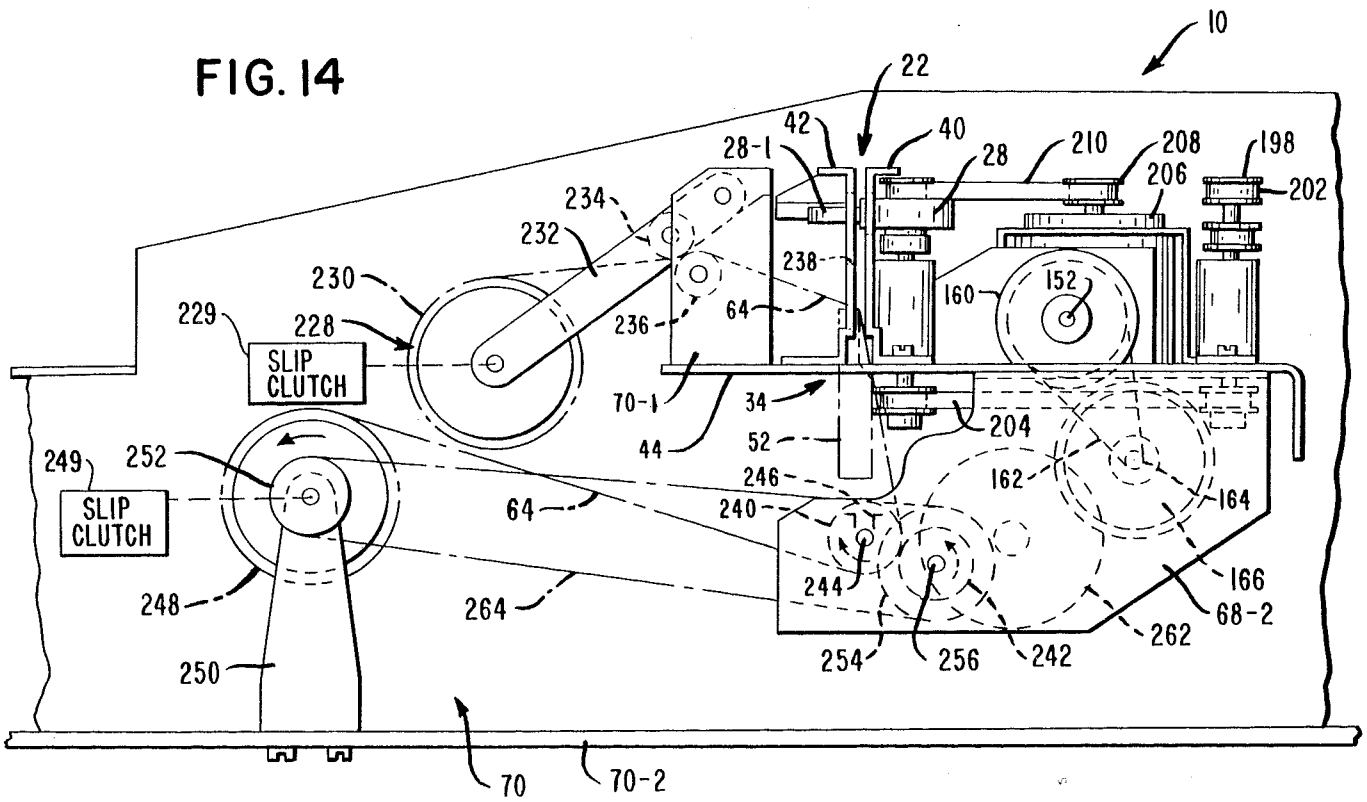
FIG. 14 shows an end view of the encoder and print module (with certain portions removed) shown in FIGS. 1A and 1B and is used to show, in diagrammatic form, the ribbon-handling mechanism associated therewith.
Figure 15:
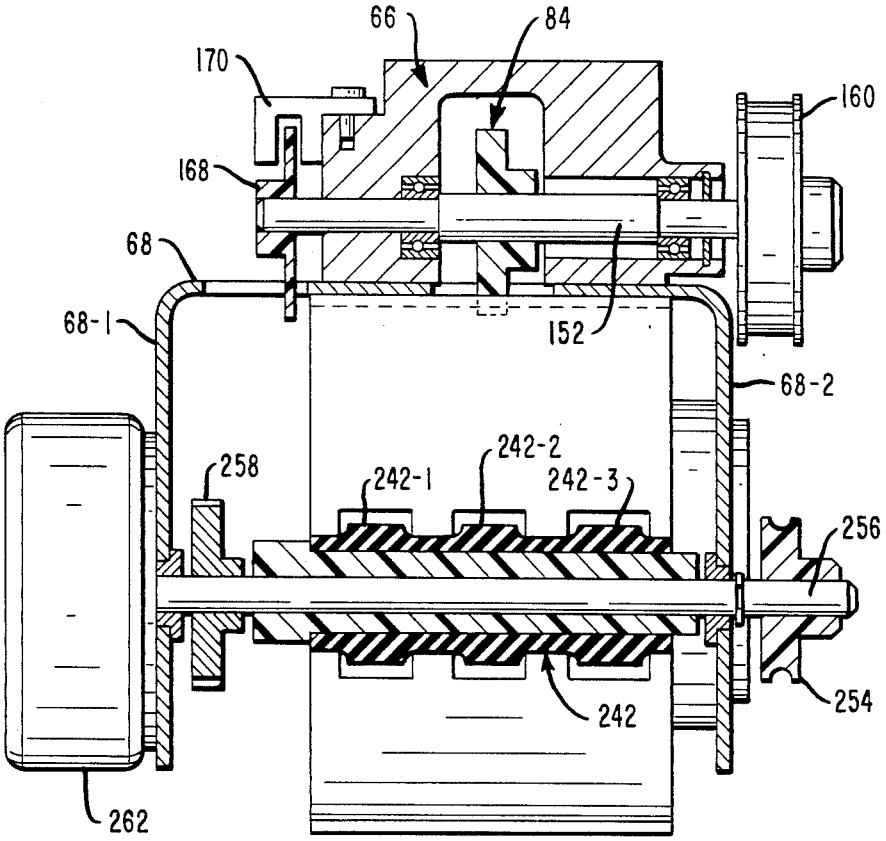
FIG. 15 is a cross-sectional view taken along the line 15—15 of FIG. 5, to show additional details of the printer module.

The mechanism 228 includes a ribbon supply reel 230 (FIG. 14) which is rotatably supported on a bracket 232 which is secured to a portion 70-1 of the frame 70. From the supply reel 230, the ribbon 64 is fed between a pair of cylindrically-shaped rollers 234 and 236, through an opening 238 of the side wall 42 of the document track 22, over the print head 52, and between a heavy drum 240 and spaced drive rollers shown collectively as 242 in FIG. 14 and shown individually as 242 1, 242-2, and 242-3 in FIG. 15. The drum 240 has its axle 244 rotatably supported in recesses like 246 in FIG. 14 which enable the drum 240 to be lifted out of the recesses 246 to facilitate the loading of the ribbon 64 between the drum 240 and the rollers 242, and thereafter, the ribbon 64 is wound up on the take-up reel 248 which is rotatably supported on a support 250 which is secured to a portion 70-2 of the frame 70. The take-up reel 248 is rotated in a counterclockwise direction, as viewed in FIG. 14, by a pulley 252 which is rotated by a pulley 254 which is fixed to rotate with shaft 256. The shaft 256 is rotated in a clockwise direction as viewed in FIG. 5 by a driving gear 258, which in turn is driven by the output gear 260 of a stepping motor 262 which is mounted in a vertically positioned plate 68-1 extending from the plate 68 as shown in FIG. 15. The shaft 256 is rotatably mounted in the vertically positioned plates 68-1 and 68-2 as shown best in FIG. 15. An "O"-type belt 264 (shown diagrammatically in FIG. 14) is used to drivingly connect the pulleys 254 (shown in dashed outline) and 252. The supply reel 228 has a slip clutch 229 associated therewith to prevent overspinning of the supply reel 228 when the ribbon 64 is removed therefrom. Similarly, the take-up reel 248 has a slip clutch 249 to enable the take-up reel 248 to accommodate different amounts of ribbon 64 thereon as it is rotated by the drive pulley 254 (FIG. 14). The drive roller 242 is incrementally indexed by the stepping motor 262 (FIG. 15) so as to pull a length of ribbon 64 past the print head 52 (FIG. 14) each time a line of printing is completed. In the embodiment described, this length of ribbon 64 fed past the print head 52 is greater than the height of a line of printing at the print station 34. The stepping motor 262 is under the control of the printer controller 172 shown in FIG. 3. To facilitate loading the ribbon 64 at the print head 52, the pin 146 (FIG. 6) is removed permitting the plate 142 with the print head 52 secured thereto to be pivoted about pin 144 in a counterclockwise direction (as viewed in FIG. 6) as previously described.

The ribbon handling mechanism 228 also includes a ribbon spring 266 shown in FIGS. 7–10 and FIG. 16 and a document wire designated generally as 268. The ribbon spring 266 has a width which is wider than the width of the ribbon 64 anticipated, and it has the general shape shown in FIG. 7 when the spring 266 is in the relaxed state and the pivoting lever 114 is in the home position. The ribbon spring 266 is secured to the underside of a block 270 by fasteners 272, with the block 270 being secured to the sidewall 42 of the document track 22.

Figure 16:
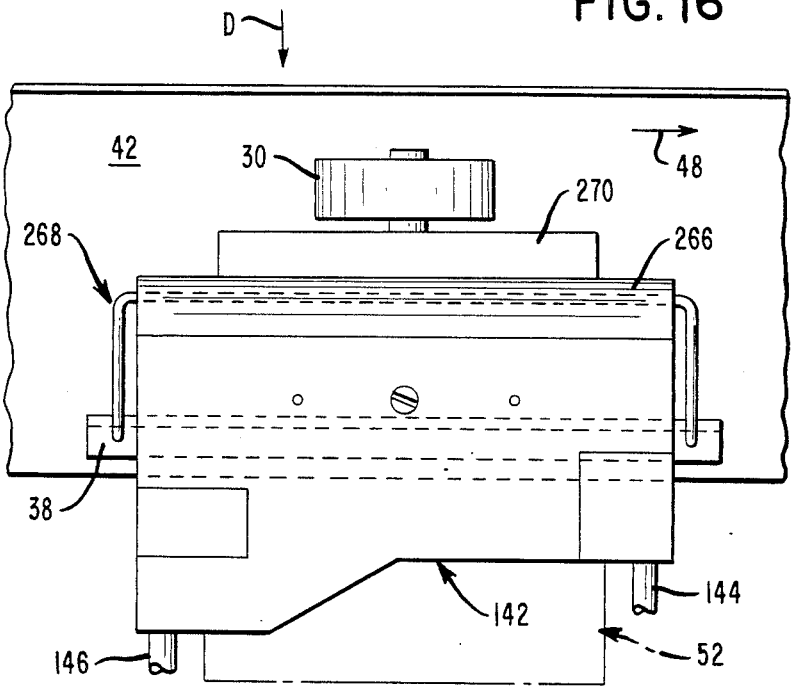
FIG. 16 is an enlarged, elevational view, taken from the direction of arrow C in FIG. 7, to show additional details of a ribbon-handling mechanism which is used to deliver the ribbon to the printer module and to facilitate the separation of the ribbon from a document after printing.
Figure 17:
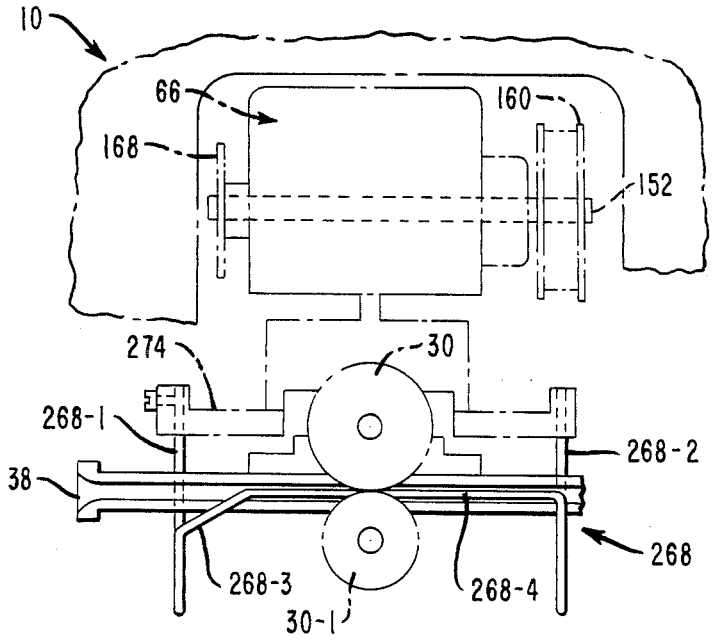
FIG. 17 is a reduced, plan view of the printer module when looking from the direction of arrow D of FIG. 16 and is used to show additional details of the ribbon-handling mechanism.

The document wire 268 alluded to has the general shape shown in FIGS. 7, 16 and 17, and it has spaced ends 268-1 and 268-2 (FIG. 17) which are inserted into and retained in a frame 274 which is fixed to reciprocate with the slide member 76 and the platen 50. The document wire 268 has an angled portion 268-3 (FIG. 17) joining a straight portion 268-4. The document wire 268 is designed to enable the straight portion 268-4 to push a document like check 14 toward the side wall 40 of the document track 22 when the platen 50 is moved toward the home position shown in FIGS. 7 and 10, for example. The angled portion 268-3 (FIG. 17) facilitates the entry of a check 14 into the print station 34 when the document wire 268 is in the home position shown in FIG. 7.

When the pivoting lever 114 pivots from the home position shown in FIG. 7 to the positions shown in FIGS. 8 and 9, the ribbon plate spring 266 is compressed somewhat as shown in FIG. 9, with the ribbon 64 lying between the ribbon spring 266 and the top of the print head 52. Once the platen 50 moves to the right as viewed in FIGS. 7 and 8, the platen 50 pushes the check 14 and the ribbon 64 against the print head 52 to the operative positions shown in FIGS. 8 and 9, for example. The document wire 268 is also moved to the right, as viewed in FIG. 8, with the slide member 76 and the platen 50 to the position shown therein. After the sequence of printing is completed as shown in FIG. 9, the platen 50 and document wire 268 begin to move to the left from the position shown in FIG. 9 to the position shown in FIG. 10; notice that in this movement the check 14 is pushed away from the ribbon 64 or is partially "peeled" therefrom. When the print head 52 is moved downwardly from the position shown in FIG. 10 to the home position shown in FIG. 7, the ribbon spring 266 expands from the position shown in FIG. 10 to the position shown in FIG. 7 to thereby facilitate the "peeling" or the separation of the ribbon 64 from the check 14 after printing. In the embodiment described, the rest position (shown in FIG. 7) of ribbon plate spring 266 has its free end located at about the halfway point in the path of movement of the top of the print head 52 in moving from the position shown in FIG. 7 to that shown in FIG. 9. An elastomer coating (not shown) is coated around the document wire 268 to minimize slippage between the wire 268 and the check 14 during the "peeling" operation mentioned. The free end of ribbon plate spring 266 is similarly coated with a layer of elastomer material (not shown) to minimize the slippage of ribbon 64 between it and the print head 52 during the peeling operation. In the embodiment described, the ribbon plate spring 266 is made of heat-treated, copper berryllium, and the elastomer material used on the ribbon spring 266 and the document wire 268 is urethane or chloroprene rubber.

In summary, some of the features and advantages of this invention are as follows:

1. The ribbon handling mechanism 228 provides a technique for peeling back the ribbon 64 after a printing operation so as to eliminate ribbon tear when a document like check 14 is moved out of the print station 34.

2. The printer module 10 enables the platen 50 and the print head 52 to establish pressure printing contact without having to cut out a large portion of the document track 22 or to create moveable sections of the track 22.

3. By separating the motion of the platen 50 from the motion of the pivoting lever 114 on which the print head 52 is mounted, the inertia experienced by the stepping motor 166 which drives the actuation means 162 (including drive cam 84) is relatively evenly distributed for a complete rotation of the drive cam 84.

4. The mounting of the platen 50 and the print head 52 provide increased horizontal and vertical stability when compared to some prior-art printers; this is required when printing in the various stylized fonts mentioned, like E13B, for example. While the platen 50 is pivotally supported on pin 108 (FIG. 6), the platen 50 is prevented from tilting and is moveable in only a single plane by the flat portions 92 and 94. Also, by having the print head 52 supported by spaced arms 138 and 140, good stability is established relative to platen 50 so that uniform platen-to-print-head pressure exists along the length of the line of printing elements 54; and 5. By enabling the print head 52 and its mounting plate 152 (FIG. 6) to pivot on pin 144, the loading of ribbon 64 is facilitated.

What is claimed is:

1. A thermal printing apparatus comprising:

a print station;

means for positioning a record medium at said print station;

means for printing on a said record medium positioned at said print station;

said means for printing comprising:

an arcuately-shaped platen;

a line of printing elements;

means for selectively energizing said printing elements in said line of printing elements;

first means for mounting said platen for reciprocal movement between printing and non-printing positions with regard to said print station;

second means for mounting said line of printing elements for pivotal movement about an axis between first and second positions with regard to said print station; and actuating means coupled to said first and second mounting means to move said platen linearly from said non-printing position to said printing position, and thereafter to pivotally move said line of printing elements through an arc from said first position to said second position so as to maintain said line of printing elements in substantial tangential relationship with said platen during movement of said line of printing elements from said first position to said second position;

said arcuately-shaped platen having a radius of curvature whose center lies at said axis when said platen is moved to said printing position by said actuating means.

2. The apparatus as claimed in claim 1 in which said means for printing further comprises a means for supplying a thermally-responsive ribbon to said print station for operative engagement with said record medium and said line of printing elements;

said supplying means also includes a means for facilitating the separation of said ribbon from said record medium; and said facilitating means includes a member which moves said record medium and said ribbon apart as said platen is moved to said non-printing position; and said facilitating means further includes a resilient member which is located at said print station and which is at least partially compressed when said line of printing elements is moved from said first position to said second position; said resilient member expanding from being compressed as said line of printing elements is moved from said second position to said first position to facilitate moving said record medium and said ribbon apart.

3. The apparatus as claimed in claim 2 in which said line of printing elements has a density concentration of 6.06 printing elements per millimeter.

4. The apparatus as claimed in claim 3 in which said actuating means includes a cam line and means for rotating said cam line in timed relationship with said means for selectively energizing said printing elements so as to effect said printing on said record medium.

5. The apparatus as claimed in claim 1 in which said second means includes a lever having spaced arms pivotally supporting said lever between its ends at said axis; said lever having said line of printing elements associated with one of its said ends with the remaining end thereof being operatively coupled to said actuating means.

6. The apparatus as claimed in claim 5 in which said second means also includes a support having said line of printing elements mounted thereon for operative engagement with said platen when said platen is in said printing position, said second means also including means for pivotally mounting said support on said lever to enable said support to be pivoted at said print station to facilitate the loading of a ribbon at said print station.

7. A thermal printing apparatus comprising:

a print station;

means for positioning a record medium at said print station;

means for printing on a said record medium positioned at said print station;

said means for printing comprising:

an arcuately-shaped platen;

a line of printing elements;

means for selectively energizing said printing elements in said line of printing elements;

first means for mounting said platen for movement between printing and non-printing positions with regard to said print station;

second means for mounting said line of printing elements of pivotal movement about an axis between first and second positions with regard to said print station; and actuating means coupled to said first and second mounting means to move said platen from said non-printing position to said printing position, and thereafter to pivotally move said line of printing elements from said first position to said second position so as to maintain said line of printing elements in substantial tangential relationship with said platen;

said arcuately-shaped platen having a radius of curvature whose center lies at said axis when said platen is moved to said printing position by said actuating means;

said second means including a lever having spaced arms pivotally supporting said lever between it ends at said axis; said lever having said line of printing elements associated with one of its said ends with the remaining end thereof being operatively coupled to said actuating means;

said second means also including a support having said line of printing elements mounted thereon for operative engagement with said platen with said platen is in said printing position, said second means also including means for pivotally mounting said support on said lever to enable said support to be pivoted at said print station to facilitate the loading of a ribbon at said print station;

said first means including:

a slide member on which said platen is mounted;

means for mounting said slide member for reciprocal movement to enable said platen to be moved between said printing and non-printing positions; and means for pivotally supporting sand platen on said slide member comprising:

first and second members extending from said slide member;

a third member extending from said slide member and being slidably mounted therein;

a resilient member biasing said third member away from said member; and a pin for pivotally mounting said platen between it ends on said third member;

said platen having elongated slots therein to receive first and second pins, respectively, which are mounted in said first and second members, respectively, to thereby limit the movement of said platen away from said slide member while permitting said platen to pivot on said pin on said third member.

8. A method of thermally printing data in association with a thermally responsive ribbon and a record medium at a print station including an arcuately-shaped stationary platen and using a line of printing elements which said printing elements are selectively energizable, comprising the steps of:

(a) positioning said record medium and ribbon at said print station in printing relationship with said line of printing elements and said platen by moving said platen linearly into operative engagement with said line of printing elements;

(b) energizing selected ones of said printing elements to effect at least partial printing of said data on said record medium;

(c) pivoting said line of printing elements in an arc during printing about the now stationary said platen so as to present said line of printing elements to a portion of said record medium yet to be printed upon;

(d) repeating steps b and c as necessary to complete the printing of said data while maintaining said record medium stationary with respect to said platen; and (e) moving said platen away from said record medium and also moving said record medium and said ribbon apart to facilitate peeling of said ribbon from said record medium.

* * * * *

UNITED STATES PATENT AND TRADEMARK OFFICE

CERTIFICATE OF CORRECTION

PATENT NO. : 4,818,126

DATED : April 4, 1989

INVENTOR(S) : Ralf M. Brooks et al.

It is certified that error appears in the above-identified patent and that said Letters Patent is hereby corrected as shown below:

Column 14, line 56, delete "of" and substitute --for--.

Column 15, line 4, delete "it" and substitute --its--.

Column 15, line 11, delete "with" and substitute --when--.

Column 15, line 22, delete "sand" and substitute --said--.

Column 15, line 29, after the word "said" insert --slide--.

Column 15, line 30, delete "it" and substitute --its--.

Signed and Sealed this

Thirty-first Day of October, 1989

*Attest:*

*Attesting Officer*

DONALD J. QUIGG

*Commissioner of Patents and Trademarks*